United States Patent [19]

Kidder

[11] 4,268,104

[45] May 19, 1981

[54] ELECTRICAL CONNECTOR

[76] Inventor: Kent A. Kidder, 6505 Salem, Apt. 107, Lubbock, Tex. 79414

[21] Appl. No.: 136,387

[22] Filed: Apr. 1, 1980

[51] Int. Cl.[3] ..... H01R 11/20; H01R 13/15

[52] U.S. Cl. ..... 339/98; 339/245; 339/248 S

[58] Field of Search ..... 339/248 R, 248 S, 273, 339/245, 223 S, 95-99, 100

[56] References Cited

U.S. PATENT DOCUMENTS

| | | | |
|---|---|---|---|
| 2,359,541 | 10/1944 | Bancroft | 339/248 S X |
| 2,521,722 | 9/1950 | Hubbell et al. | 339/248 S |
| 4,073,565 | 2/1978 | Raymond | 339/245 X |

*Primary Examiner*—John McQuade
*Assistant Examiner*—John S. Brown
*Attorney, Agent, or Firm*—Munson H. Lane, Jr.

[57] ABSTRACT

An electrical connector is disclosed comprising an elongated hollow tube having opposite sides and opposite open ends, and an elongated electrically conductive metal strap extending longitudinally within the tube. The strap has toothed ends terminating short of the opposite ends of the tube, and each end has a plurality of teeth projecting from the same side of the strap toward one side of the tube. A pair of cams project inwardly from the other side of the tube toward the one side thereof, there being one of the cams located inwardly of each end of the metal strap and bearing on the strap. The tube has an opening formed in an intermediate portion thereof from the one side extending toward the other side leaving a connecting hinge in the other side about which the opposite ends of the tube are normally folded toward each other, forming an angle substantially less than 180° in which position a pair of conductors are inserted through the opposite ends of the tube into the space between the toothed end portions of the strap and the one side of the tube. In the folded position of the tube, the cam means bear upon the strap at positions inwardly from the end portions thereof. When the tube is straightened into linear form, the toothed end portions slide under the cam means whereupon the toothed end portions are forced to bite into the conductors.

15 Claims, 4 Drawing Figures

ELECTRICAL CONNECTOR

BACKGROUND OF THE INVENTION

1. Field of the Invention

This invention relates to an electrical connector and more particularly to a tubular electrical connector having a conductive metal strap therein with gripper means at each end adapted to grip the ends of a pair of conductors positioned thereunder when the tubular conductor is folded from one form to another form about an intermediate hinge means.

2. Discussion of the Prior Art

Many forms of electrical connectors are known, however, the present invention which makes use of the folding capability of a hollow tubular connector to actuate conductor gripping means within each end of the connector, is believed to be unique.

SUMMARY OF THE INVENTION

It is an object of this invention to provide an improved electrical connector comprising a hollow tube having open opposite ends, an elongated metal strap having conductor gripping means at each end positioned within the hollow tube, and cam means fixed within the tube on one side of the strap. The hollow tube has hinge means intermediate its ends for folding the tube from a linear form to an angular form, and vice-versa. The ends of the strap within the tube slide relative to the cam means within each end of the tube as the tube is folded and unfolded. Folding the tube extends the strap ends outwardly beyond the cam means to permit the insertion of a conductor in each end of the tube beneath the gripping means at each end of the strap; unfolding the tube pulls the strap ends under the cam means so that the cam means forces the gripping means at each end of the strap to grip the conductor inserted beneath the gripping means.

It is another object of this invention to provide a tubular electrical conductor as described above wherein the hollow tube may be made of bendable metal or plastic materials and wherein the cam means comprises inwardly projecting cam surfaces within each end portion of the hollow tube, the inwardly projecting cam surfaces being formed by either deforming the wall of the hollow tube or by molding in the case where the tube is of plastic.

It is a further object of this invention to provide a tubular electrical connector wherein the mid-portion of the tube is cutaway on one side of the tube forming an opening and leaving a narrow connecting strip on the other side of the tube connecting the end portions of the tube, the connecting strip being bendable to permit the tube to be folded toward the opening. A pliable film having its margins adhered to the tube about the opening formed by cutting away the tube in its mid-portion is preferably provided to cover the opening.

It is still a further object of the invention to provide a tubular electrical connector wherein the gripping means at each end of the strap provided within the tube comprises a plurality of sharp projecting teeth for biting into the surface of conductors through insulation covering the conductors. The ends of the strap are preferably beveled and the teeth are inwardly inclined to facilitate the insertion of conductors under the ends of the strap.

It is still a further object of this invention to provide another embodiment of the invention wherein the electrical connector comprises a hollow tube bendable about an intermediate hinge means between a substantially linear position and a folded angular position and a pair of conductive metal straps within the tube, each having gripping means on opposite ends thereof facing the gripping means on the other strap. The straps are bendable as the tube is bent to a folded angular position and are straightened as the tube is straightened so that the folding of the tube causes the ends of the straps to move outwardly toward the open ends of the tube and the unfolding of the tube causes the ends of the straps to move inwardly away from the open ends of the tube. Cam means at each end of the tube bear against the ends of one of the straps as the ends of the strap move inwardly thereby forcing the gripping means on the one strap toward the gripping means on the other strap to clamp the gripping means of the two straps into electrical contact with conductors inserted through the open ends of the tube between the gripping means of the two straps.

BRIEF DESCRIPTION OF THE DRAWING

With the foregoing more important objects and features in view and such other objects and features which may become apparent as this specification proceeds, the invention will be understood from the following description taken in conjunction with the accompanying drawing, in which like characters of reference are used to designate like parts, and in which.

DETAILED DESCRIPTION OF THE PREFERRED EMBODIMENTS

Figure 1:
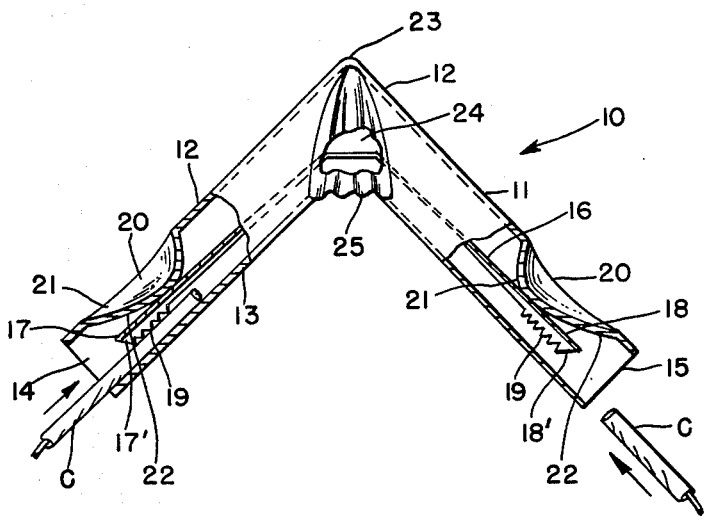
FIG. 1 is a side elevational view of the electrical connector of this invention with portions shown in section and broken away showing the connector in folded position to accept conductors through its opposite ends.

In the drawings, one embodiment of the electrical connector of this invention is generally indicated by the reference numeral 10. FIG. 1 of the drawings shows the connector folded to a position for receiving electrical conductors C, while FIG. 2 shows the connector straightened from its folded position to a linear position with a pair of conductors C inserted in opposite ends of the connector, and firmly gripped therein.

The electrical connector 10 comprises an elongated hollow tube 11 having opposite sides 12 and 13 and opposite open ends 4 and 15, and an elongated electrically conductive metal strap 16 extending longitudinally within the tube. The strap 16 has opposite end portions 17 and 18 which terminate short of the opposite open ends 14 and 15 respectively of the tube 11, and each opposite end portion has gripping means 19 on one side thereof for gripping contact with a conductor inserted through one of the open ends of the tube into position between the gripping means and the side 13 of the tube 11. In the preferred embodiment shown herein, the gripping means 19 comprises a plurality of pointed teeth projecting from the same side of the strap 16 toward the side 13 of the tube 11. Projecting inwardly from the opposite side 12 of the tube toward the side 13 are cam means 20,20 positioned inwardly of each end of the metal strap 16 and bearing on the strap. The cam means 20,20 each have a curved surface portion 21 at their point of contact with the metal strap 16, which merges with a gradually inclined surface portion 22 on the outer side of the cam facing toward an adjacent one of the open ends of the tube 11.

Figure 2:
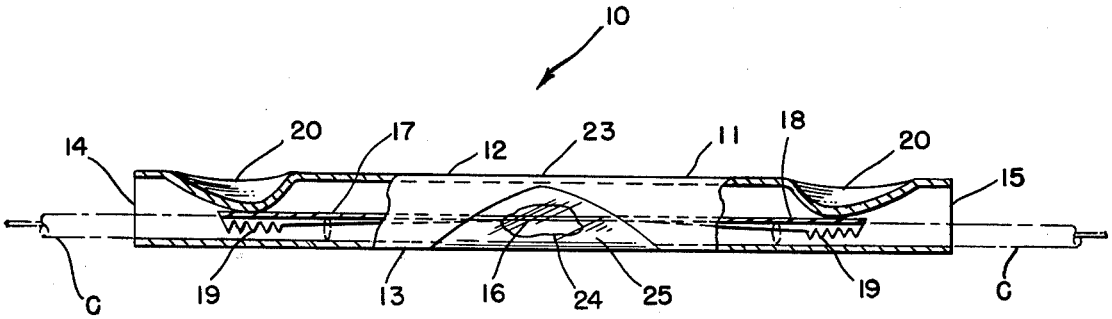
FIG. 2 is a view similar to FIG. 1 but showing the connector straightened to a linear position with conductors gripped in the opposite ends of the connector.

The tube 11 is provided with hinge means which permits the tube to be folded into the folded position shown in FIG. 1, and straightened to the linear position shown in FIG. 2. The hinge means comprises an integral connecting strip 23 on one side 12 of the tube 11, and an opening 24 extending around the tube from opposite sides of the connecting strip. The opening 24 is narrow adjacent the connecting strip 23 on opposite sides thereof and widens out to a maximum extent on the side of the tube opposite the connecting strip. The opening 24 is preferably covered with a flexible pliable thin film 25 of plastic or other suitable material which will cover the opening and permit bending of the tube. The film 25 is adhesively applied to the outside of the tube 11 in an area covering and surrounding the opening 24 when the tube 11 is straight as in FIG. 2, so that the film forms a smooth continuation of the surface of the tube, in the area of the opening 24. When the tube 11 is folded, as shown in FIG. 1, the film will wrinkle in the area of the bend, but will continue to provide a covering for the opening. The tube 11 may be made of metal or of a shape retaining plastic material having sufficient flexibility to permit folding of the tube in the hinge area 23. When the tube 11 is made of metal, the cam means 20,20 are depressions made by striking the metal tube to force it inward. When the tube is made of a plastic material, the cam means can be molded when the tube 11 is formed. The tube 11 is preferably cylindrical in shape, and if made of metal preferably has an insulation covering.

The electrical connector 10 is used to electrically connect a pair of conductors C,C inserted through the opposite ends 14 and 15 of the tube. In order to prepare the connector 11 to receive the conductors C,C, the tube is folded to an angle substantially less than 180° as shown in FIG. 1. As the tube 11 is folded, the metal strap 16 inside of the tube 11 is also bent and the end portions 17 and 18 of the strap slide outwardly relative to the cam means 20,20. In the position shown in FIG. 1, the curved surface portions 21 of the cam means 20,20 contact the metal strap 16 well inwardly of its end portions 17 and 18. Since the end portions 17 and 18 as shown in FIG. 1 are not under the cam means, they can be flexed away from the tube side 13 by pushing conductors C,C inwardly through the open ends of the tube until they slide under the end portions 17 and 18. The ends of the end portions 17 and 18 are beveled inwardly as shown at 17' and 18' to facilitate the insertion of the conductors C,C thereunder. The teeth 19 are also preferably inclined inwardly to facilitate the insertion of the conductors C,C and to insure better gripping action upon the conductors C,C upon an outward tug being applied to the conductors.

Once the conductors C,C have been inserted in the connector 10 under the gripping ends 17 and 18 of the metal strap 16, the connector 10 is straightened to the position shown in FIG. 2. In straightening the connector 10, the end portions 17 and 18 are pulled under the cam means 20,20 which force the end portions 17 and 18 toward the side wall 13 of the tube 11 and into gripping contact with the conductors C,C. The teeth 19 on the end portions 17 and 18 will pentrate the insulation covering the conductors C,C and bit into the conductors thus making good electrical contact between the conductors C,C an the emtal strap 16. The strap 16 will thus complete a circuit connection between the ends of the conductors C,C.

Figure 3:
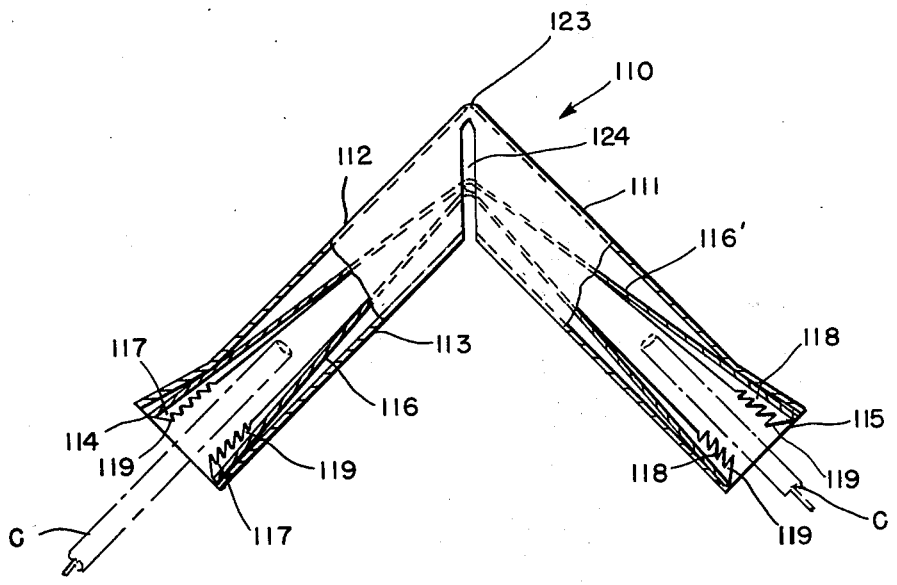
FIG. 3 is a side elevational view of a second embodiment of the invention with portions in section and broken away, and showing the connector in folded position to accept conductors through its opposite ends.
Figure 4:
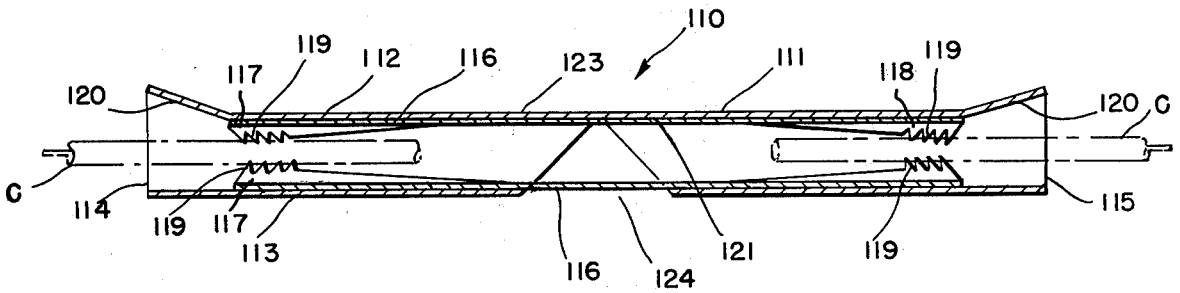
FIG. 4 is a view similar to FIG. 3 but showing the connector straightened to a linear position with conductors gripped in the opposite ends of the conductor.

In FIGS. 3 and 4 of the drawings, a second embodiment of the electrical connector of this invention is generally indicated by the reference numeral 110. FIG. 3 shows the connector folded to a position for receiving electrical conductors C,C while FIG. 4 shows the connector 110 straightened from its folded position to a linear position with a pair of conductors C,C inserted in opposite ends of the connector and firmly gripped therein.

The electrical connector 110 comprises an elongated hollow tube 111 having opposite sides 112 and 113 and opposite open ends 114 and 115, and a pair of elongated electrically conductive straps 116,116' extending longitudinally within the tube 111. Each of the straps 116 and 116' have opposite ends portions 117 and 118 which terminate short of the opposite open ends 114 and 115 respectively of the tube 111, and each opposite end portion has gripping means 119 on one side thereof for gripping contact with a conductor inserted through one of the open ends of the tube into position between the end portions of the oppositely facing straps 116 and 116'. The gripping means 119 like the gripping means 19 shown in FIGS. 1 and 2 preferably comprise a plurality of pointed teeth projecting from the same side of the strap. The gripping means 119 on the strap 116 project toward the strap 116' while the gripping means 119 on the strap 116' project toward the strap 116.

The tube 111 is provided with hinge means which permits the tube to be folded into the folded position shown in FIG. 3, and straightened to the linear position shown in FIG. 4. The hinge means comprises an integral connecting strip 123 on one side 112 of the tube 111, and an opening 124 extending around the tube from opposite sides of the connecting strip. The opening 124 is narrow adjacent the connecting strip 123 on opposite sides thereof and widens out to a maximum extent on the side of the tube opposite the connecting strip. The opening 124 like the opening 24 of connector 10 is preferably covered witha flexible pliable thin film (not shown) of plastic or other suitable material which will cover the opening and permit bending of the tube. The tube 111 may be made of metal or of a shape retaining plastic material having sufficient flexibility to permit folding of the tube in the hinge area 123. The tube 111 is preferably cylindrical in shape, and if made of metal preferably has an insulation covering (not shown).

The end portions of the tube 111 adjacent the open ends 114 and 115 are outwardly flared, at least on one side, to provide gradually inwardly inclined cam surfaces 120, 120 which merge with the cylindrical inner surface 121 of the main intermediate portion of the tube.

The electrical connector 110 is used to electrically connect a pair of conductors C,C inserted through the opposite ends 114 and 115 of the tube. In order to prepare the connector 110 to receive the conductors C,C, the tube 111 is folded to an angle substantially less than 180° as shown in FIG. 3. As the tube 111 is folded, the metal straps 116 and 116' inside of the tube 111 are also bent and the end portions 17 and 18 of the straps slide outwardly relative to the cam means 120,120 until the ends of the straps 116 and 116' are adjacent the open ends 114 and 115 of the tube 111. With the end portions of the opposed straps 116 and 116' in the flared end portions of the tube 111, the end portions of the straps 116 and 116' are spread apart in order to receive conductors C,C between the opposed gripping means 119 on each end of the straps.

Once the conductors C,C have been inserted in the connector 110 under the gripping ends 117 and 118 of the metal straps 116 and 116', the connector 110 is straightened to the position shown in FIG. 4. In straightening the connector 110, the end portions 117 and 118 of the straps 116 and 116' are pulled inwardly. As the end portions of the strap 116' move inwardly from the ends of the tube 111, they slide relative to the cam surfaces 120,120 and are forced toward the end portions of the opposite strap 116 closing the gripping means 119 on the opposed strap ends against the conductors C,C. The teeth of the gripping means 119 penetrate the insulation covering the conductors C,C and bite into the conductors thus making good electrical contact between the conductors and conductive straps 116, 116'. The straps 116 and 116' will thus complete a circuit connection between the ends of the conductors C,C.

It is within the scope of this invention that the gripping means on the ends of the strap 16 of connector 10 and straps 116 and 116' of connector 110 may comprise other means than the pointed teeth 19 and 119 shown in the drawings. For example, the ends of the straps 16, 116 and 116' may have short portions bent perpendicular to the main body of the strap of approximately the same length as the teeth 19 shown in FIGS. 1 and 2, and slots formed in the short bent portions having edges converging inwardly from the ends of the short bent portions may be forced down over conductors inserted beneath the ends. The edges of the slots may be sharpened to cut through insulation covering the conductors.

The hollow tubes 11 and 111 may be filled with petroleum jelly to prevent water penetration of the connectors 10 and 110.

The preferred usuage of the connectors of this invention will be for electric wires and telephone wires, however, they may have other applications.

While in the foregoing there has been described and shown a preferred embodiment of the invention, various modifications and equivalents may be resorted to within the spirit and scope of the invention as claimed.

What is claimed is:

1. An electrical connector comprising an elongated hollow tube having opposite sides and opposite open ends, and an elongated electrically conductive metal strap extending longitudinally within said tube and having opposite end portions terminating short of the opposite ends of said tube, a plurality of teeth projecting from each end portion of said strap on one side thereof facing one of the opposite sides of said tube and terminating short thereof, a pair of cam means projecting from the other side of said tube toward said one side, there being one of said pair of cam means located inwardly of each end of said metal strap and bearing on said strap, said tube having an intermediate opening formed in said one side and extending toward the other side around said tube leaving a connecting hinge in said other side about which the opposite ends of the tube are normally folded toward each other on the side of said opening, forming an angle between said ends of substantially less than 180° in which position said connector is adapted for the insertion of conductors through the opposite open ends of said tube into the space between the toothed end portions of said strap and said one side, said cam means bearing upon said strap inwardly from said toothed end portions, said toothed end portions of said strap being slidable under said cam means as said tube is straightened into a linear form where said cam means force the toothed ends closer to said one side and thus cause the toothed ends of said strap to bite into said conductors.

2. The electrical connector of claim 1 wherein said intermediate opening in said tube is covered by a flexible pliable film.

3. The electrical connector of claim 1 wherein said tube is of metal, and said cam means are depressions formed in said metal tube.

4. The electrical connector of claim 1 wherein said tube is of plastic material and said cam means are projections molded inside of said tube.

5. An electrical connector comprising an elongated hollow tube having opposite open ends and an elongated conductive metal strap extending longitudinally within said tube, said tube having hinge means intermediate the ends thereof for folding the opposite ends of the tube from a substantially linear condition to a folded angular condition of substantially less than 180°, said strap having opposite end portions, each of which has gripping means on one side thereof for gripping an electrical conductor, and cam means between one side of said tube and the side of said strap opposite the side having the gripping means, said cam means comprising cam surfaces which in the folded position of said tube bear on the strap at positions inwardly from the opposite ends of said strap providing space between said gripping means on the opposite ends of said strap and said tube for the insertion of electrical conductors through said open ends to a position interposed between said gripping means and said tube, said opposite end portions of said strap being pulled under said cam means as the tube is straightened from a folded to a linear condition whereby said cam means force said gripping means toward the side of said tube opposite said one side, and into gripping engagement with said conductors.

6. The electrical conductor of claim 5 wherein said gripping means at each end of said strap comprise a plurality of projecting teeth which bite into the conductor through insulation covering the conductor.

7. The electrical connector of claim 5 wherein said tube is of metal, and said cam means are depressions formed in said metal tube.

8. The electrical connector of claim 5 wherein said tube is of plastic material and said cam means are projections molded inside of said tube.

9. The electrical connector of claim 5 wherein said hinge means comprises an integral connecting strip on one side of said tube and an opening extending around said tube from opposite sides of said connecting strip, said opening being narrow adjacent the opposite sides of said strip and widening out to a larger opening on the side of said tube opposite said connecting strip.

10. The electrical connector of claim 9 wherein said opening is covered by a pliable film.

11. A hollow tube electrical connector having open ends and a pair of conductive straps positioned therein in spaced apart overlying relationship, gripping means on each end of said straps with the gripping means on one strap facing the gripping means on the other strap providing opposed gripping means at opposite ends of said straps, said tube being bendable about a mid position hinge means between a linear position and a folded angular position, said conductive straps being also bendable within said tube and the end portions of said straps being movable outwardly as the tube is bent angularly and being movable inwardly as the tube is straightened, and cam means at opposite ends of said tube which permit said opposed gripping means to open as the tube is bent into a folded angular position for the reception of conductors between said opposed gripping means, and which close said gripping means on said conductors as said tube is straightened.

12. The electrical connector of claim 11 wherein said gripping means at each end of said straps comprise a plurality of projecting teeth.

13. The electrical connector of claim 11 wherein said hinge means comprises an integral connecting strip on one side of said tube and an opening extending around said tube from opposite sides of said connecting strip, said opening being narrow adjacent the opposite sides of said strip and widening out to a larger opening on the side of said tube opposite said connecting strip.

14. The electrical connector of claim 13 wherein said opening is covered by a pliable film.

15. A hollow tube electrical connector having open ends and at least one conductive strap positioned therein along one side of said tube, gripping means on each end of said strap facing an opposite side of said tube, said tube being bendable about a mid position on said one side of said tube into a folded angular position, said conductive strap being also bendable within said tube and the end portions of said strap being movable outwardly as the tube is bent angularly and being movable inwardly as the tube is straightened, and cam means at opposite ends of said tube on said one side which permit electrical conductors to be inserted between the gripping means at opposite ends of the strap and the opposite side of said when the tube is bent into a folded angular position and which force said gripping means toward said opposite side to grip said conductors between said gripping means and said opposite side as said tube is straightened.

* * * * *